US008654162B2

(12) United States Patent
Asahina

(10) Patent No.: US 8,654,162 B2
(45) Date of Patent: Feb. 18, 2014

(54) PRINTING APPARATUS

(75) Inventor: Shigetoshi Asahina, Shizuoka (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 275 days.

(21) Appl. No.: 13/024,453

(22) Filed: Feb. 10, 2011

(65) Prior Publication Data

US 2011/0216146 A1 Sep. 8, 2011

(30) Foreign Application Priority Data

Mar. 3, 2010 (JP) ..... 2010-46957

(51) Int. Cl.
*B41J 2/32* (2006.01)

(52) U.S. Cl.
USPC ..... 347/197

(58) Field of Classification Search
USPC ..... 347/171, 173, 197, 212, 218, 220–223, 347/204; 400/120.01, 120.18, 578
See application file for complete search history.

(56) References Cited

U.S. PATENT DOCUMENTS

| | | | | |
|---|---|---|---|---|
| 5,921,687 | A * | 7/1999 | Koike et al. | 400/120.01 |
| 7,246,959 | B2 * | 7/2007 | Nakatani | 400/120.18 |
| 2005/0243157 | A1 * | 11/2005 | Nakatani | 347/197 |
| 2007/0273744 | A1 * | 11/2007 | Yamada et al. | 347/204 |
| 2008/0094463 | A1 * | 4/2008 | Tsuchida et al. | 347/197 |
| 2009/0185022 | A1 * | 7/2009 | Koyabu | 347/197 |
| 2010/0295916 | A1 * | 11/2010 | Kaufman | 347/171 |

FOREIGN PATENT DOCUMENTS

| | | |
|---|---|---|
| JP | 06-063357 | 3/1994 |
| JP | 2001-071569 | 3/2001 |
| JP | 2002-358019 | 12/2002 |
| JP | 2003-261841 | 9/2003 |
| JP | 2005-066982 | 3/2005 |
| JP | 2007-320189 | 12/2007 |

* cited by examiner

*Primary Examiner* — Kristal Feggins
(74) *Attorney, Agent, or Firm* — Turocy & Watson, LLP

(57) ABSTRACT

According to one embodiment, a printing apparatus includes a conveying unit configured to convey a printing medium in a conveying direction. The apparatus further includes a printing unit configured to print at least one side of the printing medium with information. The printing unit may extend in a direction perpendicular to a conveying direction of the printing medium and may be arranged relative to the conveying unit so as to position at least one end portion of the printing medium into a printable region of the printing unit.

11 Claims, 9 Drawing Sheets

PRINTING APPARATUS

CROSS-REFERENCE TO RELATED APPLICATIONS

This application is based upon and claims the benefit of priority from Japanese Patent Application No. 2010-046957, filed on Mar. 3, 2010, the entire content of which is incorporated herein by reference.

FIELD

Embodiments described herein relate generally to a printing apparatus that prints double sides of a label with information using a thermal printer, for example.

BACKGROUND

A printing apparatus which prints double sides of a label with information using a thermal printer has a thermal head that may be provided in a direction perpendicular to a direction of conveying a label, and prints the label with information by making a printable region of the thermal head face the label.

Typically, a label is detachably stuck on a mount (or a liner), which is prepared and folded in a setting part in the form of a roll or a bellow and then is discharged from the setting part and conveyed to a thermal head. The label printed with information by the thermal head is peeled off from the mount for use.

However, the mount from which the label is removed may be often discarded with no particular use, which causes environmental issues.

For the purpose of addressing such an issue, a mount-free label (or a linerless label) has been used and is drawing attention as an environment-friendly medium.

Recently, there have been proposed techniques in which one side of a linerless label is printed for a later use as both front and rear surfaces. Then, the printed linerless label is folded at a position between two printed areas for use as the front and rear surfaces, which are attached to each other by facing two sticky backsides of the surfaces. The front and rear surfaces attached to each other are peeled off to attach the label to an article.

In addition, in recent years, there has been also proposed a mechanism for printing both sides of a printing medium with information at once. In addition, there has been proposed a labeler which uses a linerless label with front and rear surfaces, both of which are provided with printed areas, respectively. Accordingly, without having to fold the label after printing, the two surfaces attached to each other at sticky portions are peeled off to attach the label to an article.

However, in this labeler, thermal heads are arranged over a portion (e.g., a center portion) of the label with both end portions of the label (arranged in a direction perpendicular to a conveying direction of the label) extend out of a printable region of the thermal heads. Therefore, a blank space (unprinted area) remains in a folded portion of the label when the double-sided printed label is unfolded to be attached to an article, which may result in discontinuity of print information.

EIG. 7 is a front view of the label being unfolded.

Figure 8:
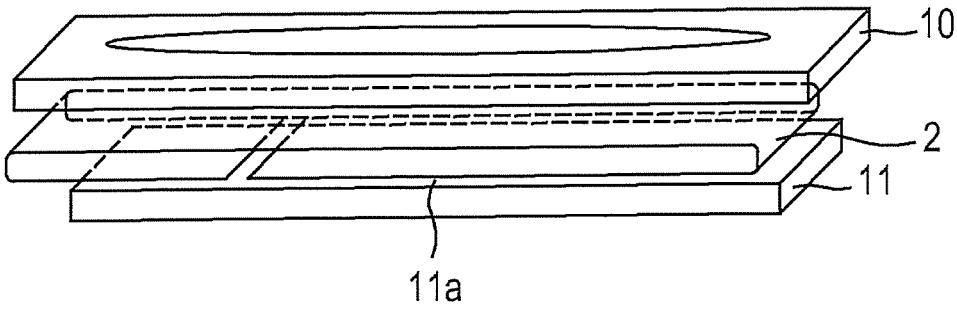

FIG. 8 is a perspective view showing arrangement of first and second thermal heads according to a second illustrated embodiment.

Figure 9:
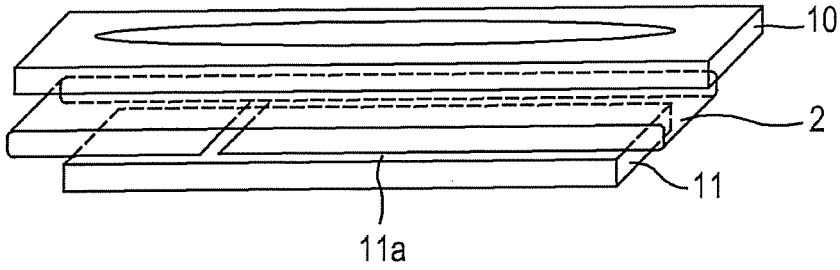

FIG. 9 is a perspective view showing arrangement of first and second thermal heads according to a third illustrated embodiment.

Figure 10:
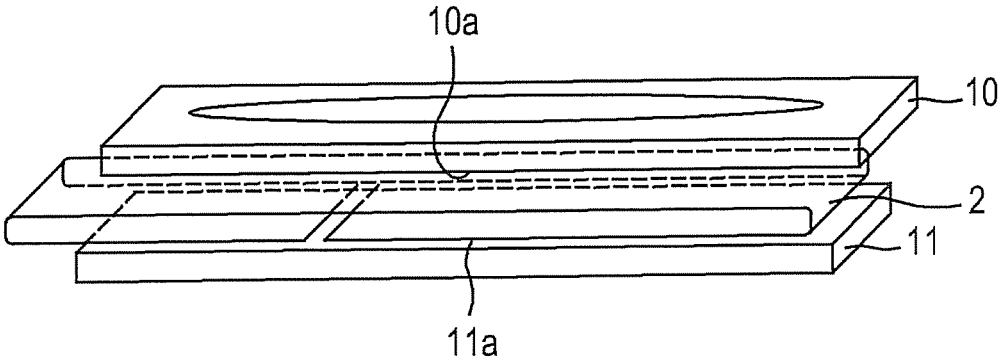

FIG. 10 is a perspective view showing arrangement of first and second thermal heads according to a fourth illustrated embodiment.

Figure 11:
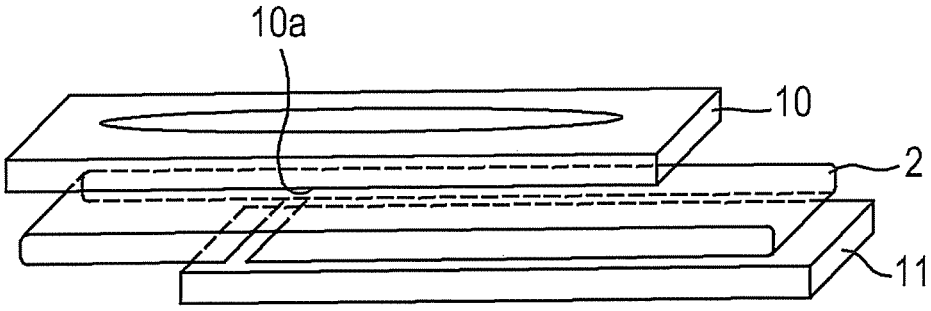

FIG. 11 is a perspective view showing arrangement of first and second thermal heads according to a fifth illustrated embodiment.

Figure 12:
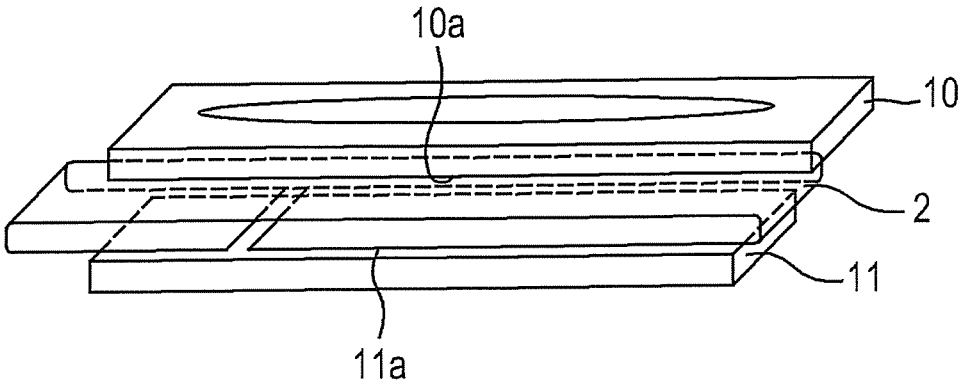

FIG. 12 is a perspective view showing arrangement of first and second thermal heads according to a sixth illustrated embodiment.

Figure 13:
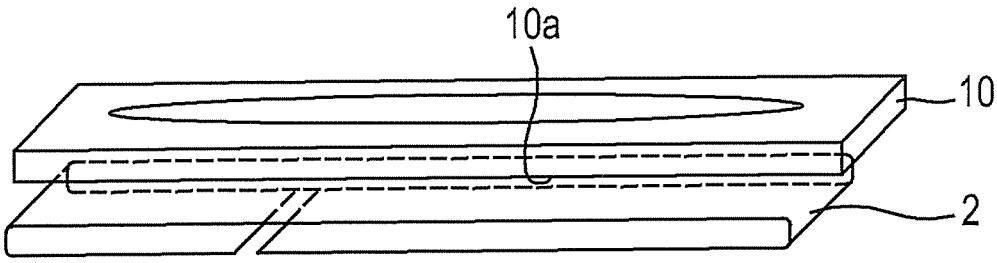

FIG. 13 is a perspective view showing arrangement of first and second thermal heads according to a seventh illustrated embodiment.

Figure 14:
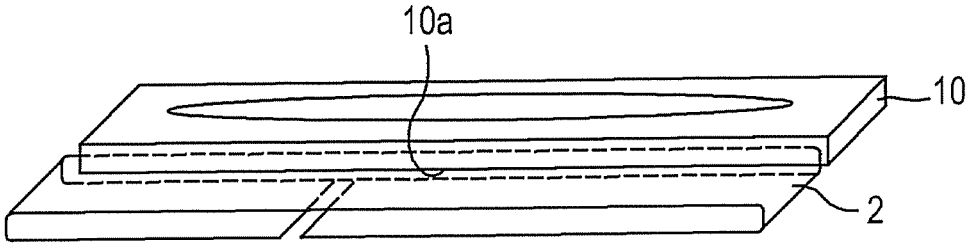

FIG. 14 is a perspective view showing arrangement of first and second thermal heads according to an eighth illustrated embodiment.

Figure 15:
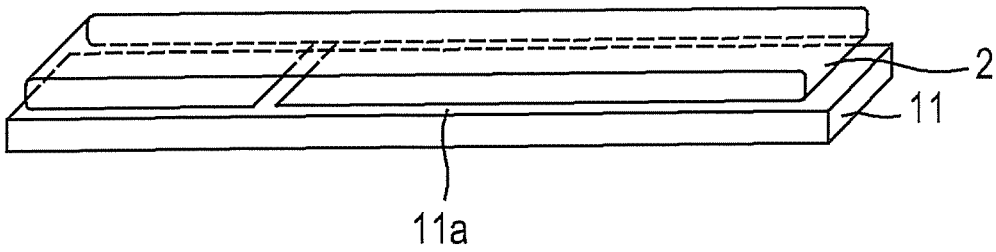

FIG. 15 is a perspective view showing arrangement of first and second thermal heads according to a ninth illustrated embodiment.

Figure 16:
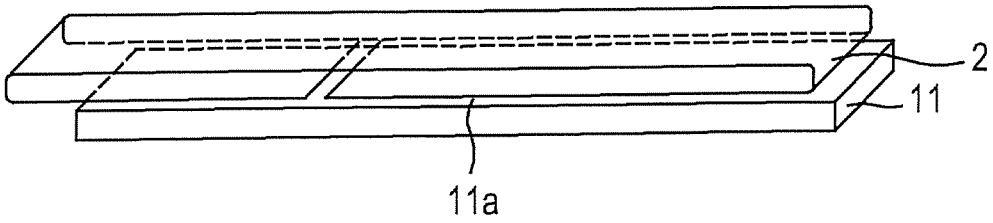

FIG. 16 is a perspective view showing arrangement of first and second thermal heads according to an tenth illustrated embodiment.

DETAILED DESCRIPTION

According to one embodiment, a printing apparatus includes a conveying unit configured to convey a printing medium in a conveying direction. The apparatus further includes a printing unit configured to print at least one side of the printing medium. The printing unit may extend in a direction perpendicular to a conveying direction of the printing medium and may be arranged relative to the conveying unit so as to position at least one end portion of the printing medium into a printable region of the printing unit.

Embodiments will now be described in detail with reference to the drawings.

Figure 1:
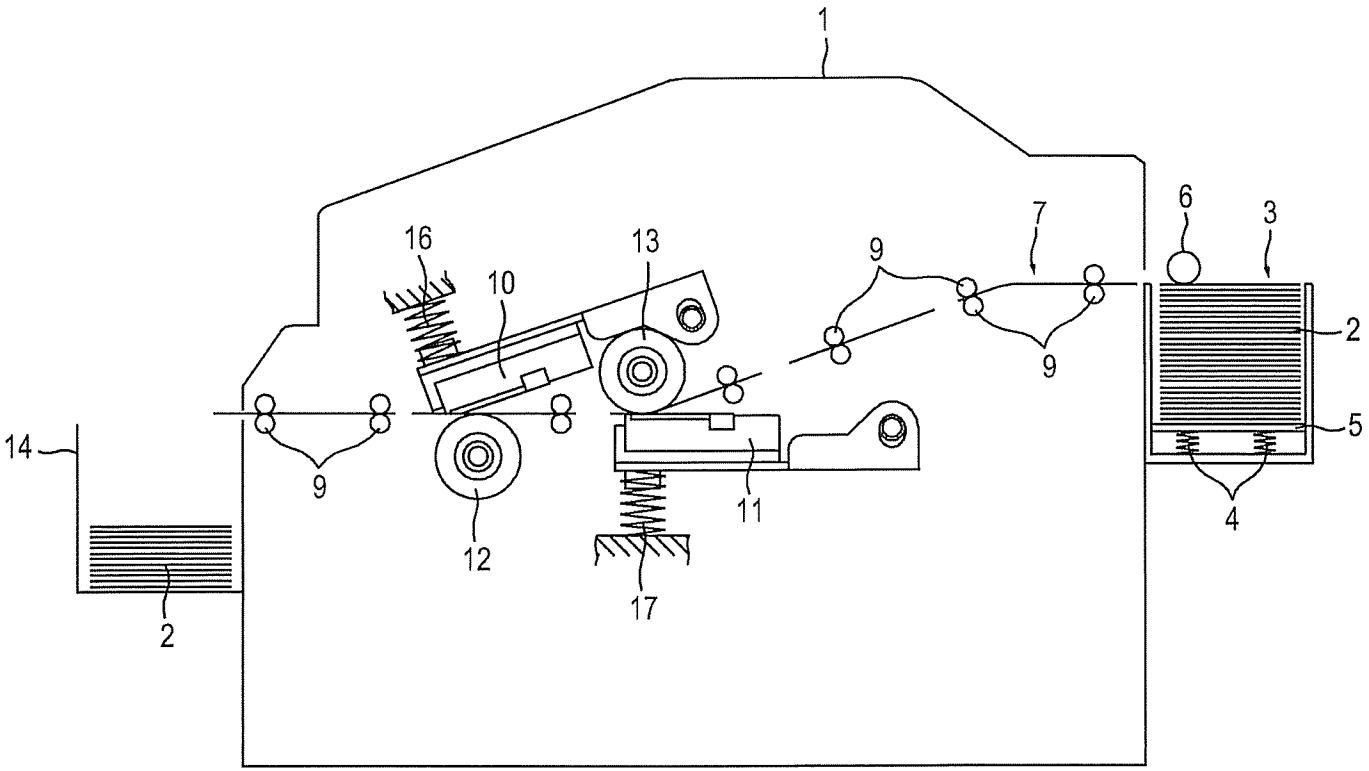
FIG. 1 is a schematic view showing a structure of a printing apparatus according to an illustrative embodiment.

FIG. 1 shows a printing apparatus according to an illustrative embodiment.

A printing apparatus includes an apparatus body 1 whose one side is provided with a supply unit 3 which supplies a plurality of labels 2 as printing media stacked therein. The labels 2 are loaded (or mounted) on a mounting board 5 and pressed upward in a direction toward a top portion of the body 1 by means of a spring member 4. The top of the labels 2 contacts a take-out roller 6 which may rotate to discharge the labels 2 one-by-one.

Inside the apparatus body 1 is provided a conveying path 7 along which the labels 2 discharged by the take-out roller 6 are conveyed. A plurality of conveying roller pairs 9 (also referred to as "conveying units") are arranged along the conveying path 7 to convey the labels 2 being interposed therebetween. Also, on the conveying path 7 are provided first and second thermal heads 10 and 11 (also referred to as "first and second line heads" or "printing units") for printing information on the conveyed labels 2.

Platen rollers 12 and 13 are arranged so as to oppose the first and second thermal heads 10 and 11, respectively, with the conveying path 7 interposed therebetween. The thermal heads 10 and 11 are elastically pressed by respective spring members 16 and 17 so that the heads 10 and 11 can contact the platen rollers 12 and 13, respectively.

On the other (opposing) side of the apparatus body 1 is provided a collection unit 14 which collects the printed labels 2 discharged out of the conveying path 7.

Figure 2:
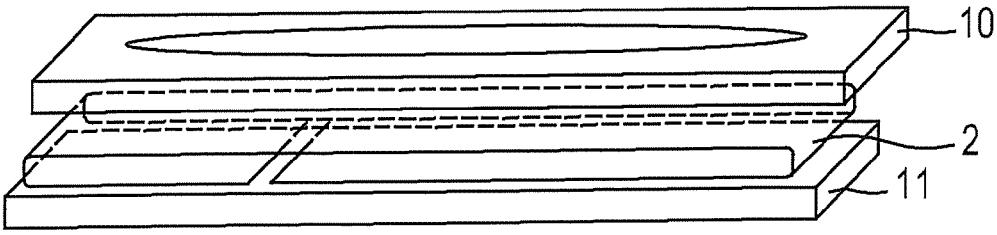
FIG. 2 is a perspective view showing an arrangement of first and second thermal heads of the print apparatus.
Figure 3:
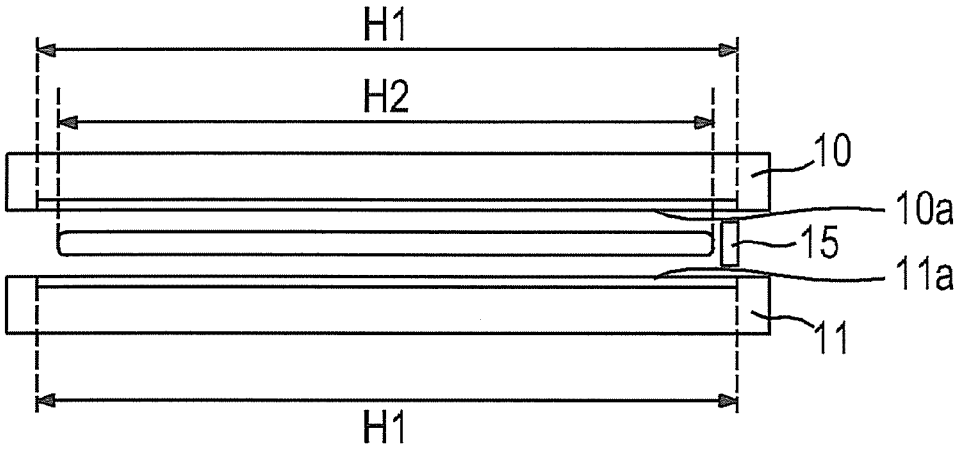
FIG. 3 is a front view showing an arrangement of first and second thermal heads of the print apparatus.

FIGS. 2 and 3 are a perspective view and a front view showing an arrangement of the first and second thermal heads 10 and 11, respectively.

As shown in FIG. 3, the first and second thermal heads 10 and 11 have respective printable regions 10*a* and 11*a*. A width dimension H1 of each of the printable regions 10*a* and 11*a* of the first and second thermal heads 10 and 11 extends in a direction perpendicular to the label conveying direction. Width dimension H1 is set to be larger than a width dimension H2 of each of the labels 2 extending in the same direction. In addition, the label 2 is conveyed with one end portion thereof being guided by a guide member 15 provided on the conveying path 7.

Thus, when the label 2 is conveyed through the first and second thermal heads 10 and 11, the first and second thermal heads 10 and 11 may be arranged such that both end portions of the label 2 extending in the direction perpendicular to the conveying direction are positioned within the printable regions 10*a* and 11*a*.

Figure 4:
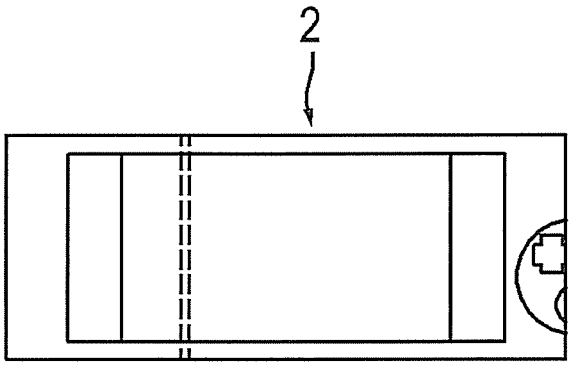
FIG. 4 is a plan view of a label according to an illustrative embodiment.
Figure 5:
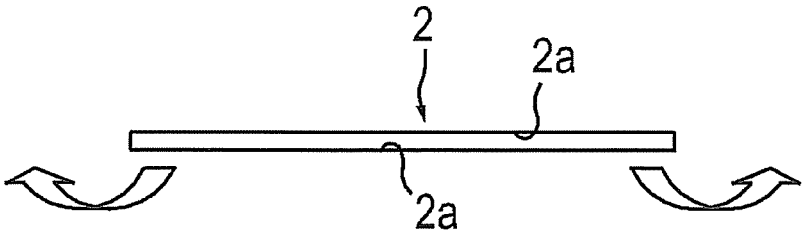
FIG. 5 is a front view of the label.

In addition, as shown in FIGS. 4 and 5, the label 2 includes adhesive surfaces 2*a*, one portion of which can be overlapped and detachably engaged to the other portion to form a folded region thereby, when the label 2 is folded about halfway.

In the following, exemplary printing operation of the printing apparatus as configured above will be described.

First, the label 2 is discharged out of the supply unit 3 as the take-out roller 6 rotates. The discharged label 2 is inserted between the conveying roller pairs 9 by rotation of the conveying roller pairs 9 and is conveyed along the conveying path 7. Both sides of the conveyed label 2 are printed with print information by the first and second thermal heads 10 and 11. The label 2 having both sides printed is discharged from the conveying path 7 and is collected in the collection unit 14. The label 2 collected in the collection unit 14 is taken out of the collection unit 14 and may be unfolded for later use, as shown in FIGS. 6 and 7.

As described above, in this embodiment, since the first and second thermal heads 10 and 11 are arranged such that both end portions of the conveyed label 2 extending in the direction perpendicular to the direction of conveying the label 2 are positioned within the printable regions 10*a* and 11*a*, the label 2 can continue to be printed with information 2*b* on both end portions.

Figure 6:
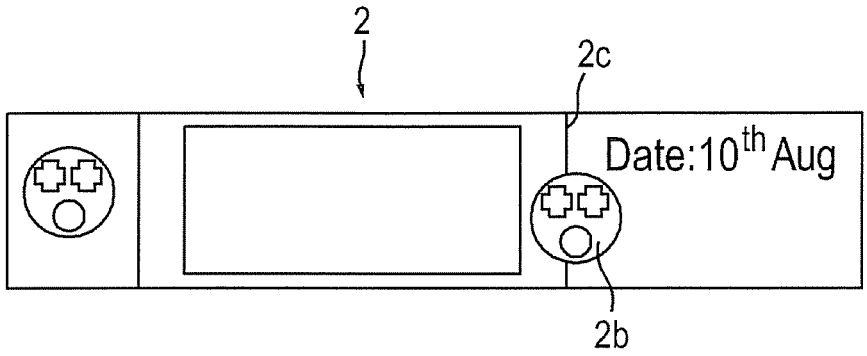
FIG. 6 is a plan view of the label being unfolded.
Figure 7:
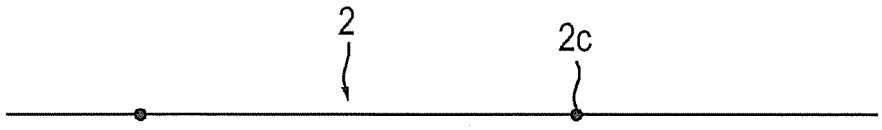

Accordingly, when the label 2 is unfolded for later use, discontinuity in printing may be avoided in a folded region 2*c*, where the printing information 2*b* can be printed without being divided in the same region, for example as shown in FIG. 6, thereby providing good quality of printing.

Although in the above embodiment the first and second thermal heads 10 and 11 are arranged such that both end portions of the conveyed label 2 are positioned into the printable regions 10*a* and 11*a*, the present invention is not limited thereto. For example, as shown in FIG. 8, although the first thermal head 10 may be arranged in the same manner as the embodiment as described above referring to FIGS. 2 and 3, the second thermal head 11 may be arranged such that one end portion of the conveyed label 2 is positioned into the printable region 11*a* while the other end portion may be positioned out of the printable region 11*a*.

Alternatively, as shown in FIG. 9, although the first thermal head 10 may be arranged in the same manner as the embodiment as described above referring to FIGS. 2 and 3, the second thermal head 11 may be arranged such that both end portions of the conveyed label 2 may be positioned out of the printable region 11*a*.

In another embodiment, as shown in FIG. 10, the first and second thermal heads 10 and 11 may be arranged such that one end portion of the conveyed label 2 is positioned into the printable regions 10*a* and 11*a*, respectively, while the other end portion is positioned out of the printable regions 10*a* and 11*a*.

In another embodiment, as shown in FIG. 11, the first thermal head 10 may be arranged such that a first end portion of the conveyed label 2 is positioned out of the printable region 10*a* while a second end portion is positioned into the printable region 10*a*. On the other hand, the second thermal head 11 may be arranged such that the first end portion of the conveyed label 2 is positioned into the printable region 11*a* while the second end portion is positioned out of the printable region 11*a*.

In an alternative embodiment, as shown in FIG. 12, the first thermal head 10 may be arranged such that one end portion of the conveyed label 2 is positioned into the printable region 10*a* and the other end portion is positioned out of the printable region 10*a*, while the second thermal head 11 may be arranged such that both end portions of the label 2 are positioned out of the printable region 11*a*.

In some embodiments, as shown in FIG. 13, only the first thermal head 10 may be provided above the conveyed label 2 to be arranged such that both end portions of the conveyed label 2 are positioned into the printable region 10*a*.

In another embodiment, as shown in FIG. 14, only the first thermal head 10 may be provided above the conveyed label 2 to be arranged such that one end portion of the conveyed label 2 is positioned in the printable region 10*a* while the other end portion is positioned out of the printable region 10*a*.

In addition, as shown in FIGS. 15 and 16, only the second thermal head 11 may be provided below the conveyed label 2 to be arranged such that one or both end portions of the conveyed label 2 are positioned into the printable region 11*a*.

Although the label 2 is folded and the folded portions may be attached to each other in the above embodiments, a typical single sheet may be employed as a printing medium without being folded.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A printing apparatus comprising:

a conveying unit configured to convey a printing medium in a conveying direction; and a printing unit configured to print at least one side of the printing medium, the printing unit extending in a direction perpendicular to the conveying direction of the printing medium and being arranged relative to the conveying unit so as to position at least one end portion of the printing medium into a printable region of the printing unit, said at least one end portion extending along the conveying direction.

2. The apparatus of claim 1, wherein the printing unit includes a first line head configured to print one side of the printing medium, and a second line head configured to print the other side of the printing medium.

3. The apparatus of claim 2, wherein the first and second line heads are thermal heads.

4. The apparatus of claim 2, wherein the first and second line heads comprise first and second printable regions respectively, and wherein a width dimension of each of the first and second printable regions extending in the direction perpendicular to the conveying direction is longer than a width dimension of the printing medium measured in the direction perpendicular to the conveying direction.

5. The apparatus of claim 4, further comprising a guide member configured to guide one end portion of the printing medium, the guide member being further configured to position both end portions of the printing medium extending in the direction perpendicular to the conveying direction, into the first and second printable regions.

6. The apparatus of claim 2, wherein the first line head is arranged within the printing unit to position both end portions of the printing medium extending in the direction perpendicular to the conveying direction into the first printable region, and wherein the second line head is arranged within the printing unit to position one end portion of the printing medium to within the second printable region while positioning the other end portion of the printing medium out of the second printable region.

7. The apparatus of claim 1, wherein the printing medium is a foldable label having a folded region, and wherein portions of the label divided by the folded region are configured to attachably engage each other.

8. A printing apparatus comprising:

a conveying unit configured to convey a printing medium in a conveying direction;

a first line head configured to print one side of the printing medium; and a second line head configured to print the other side of the printing medium, wherein the first and second line heads are arranged to extend in a direction perpendicular to the conveying direction of the printing medium and to position at least one end portion of the printing medium in the direction perpendicular to the conveying direction into at least one of printable regions of the first and second line heads, said at least one end portion extending along the conveying direction.

9. The apparatus of claim 8, wherein the printing medium is a foldable label having a folded region, and wherein portions of the label divided by the folded region are configured to attachably engage to each other.

10. The apparatus of claim 8, wherein the first and second line heads comprise first and second printable regions respectively, and wherein a width dimension of each of the first and second printable regions extending in the direction perpendicular to the conveying direction is longer than a width dimension of the printing medium measured in the direction perpendicular to the conveying direction.

11. The apparatus of claim 10, further comprising a guide member configured to guide one end portion of the printing medium, the guide member being further configured to position both end portions of the printing medium extending in the direction perpendicular to the conveying direction within the first and second printable regions.

* * * * *